United States Patent [19]

Schaab et al.

[11] 4,050,267

[45] Sept. 27, 1977

[54] SLIVER HIGH PILE FABRIC KNITTING MACHINE

[76] Inventors: Rudolph S. Schaab, Rte. 2, Lakeview Road, Caryville, Tenn. 37714; John C. Harralson, 7501 S. Whispering Oak, Powell, Tenn. 37849

[21] Appl. No.: 670,400

[22] Filed: Mar. 25, 1976

[51] Int. Cl.[2] ..... D04B 9/12

[52] U.S. Cl. ..... 66/9 B

[58] Field of Search ..... 66/9 B, 9

[56] References Cited

U.S. PATENT DOCUMENTS

| | | | |
|---|---|---|---|
| 3,153,335 | 10/1964 | Hill | 66/9 B |
| 3,226,952 | 1/1966 | Cassady | 66/9 B |
| 3,413,823 | 12/1968 | Beucus et al. | 66/9 B |
| 3,709,002 | 1/1973 | Brandt et al. | 66/9 B |
| 3,886,767 | 6/1975 | Dargie | 66/9 B |

*Primary Examiner*—Ronald Feldbaum

*Attorney, Agent, or Firm*—Robert B. Frailey

[57] ABSTRACT

Means are provided for increasing the productive capacity of a sliver high pile fabric circular knitting machine. The invention comprises an improvement whereby one or more of the sliver and yarn feeding stations of the knitting machine are modified to knit two or more fiber-retaining fabric courses during each revolution of the needle cylinder. Each station is provided with a sliver feeding device for delivering a plurality of separate, spaced rovings of sliver fibers to separate, arcuately or angularly spaced fixed locations of the needle circle. Plural yarn feeding means, knitting cams and air nozzles are provided at each station. The yarn feeding means, knitting cams and air nozzles are angularly spaced, relative to the needle circle, and each is associated with a separate roving fed by the sliver feeding means.

9 Claims, 3 Drawing Figures

SLIVER HIGH PILE FABRIC KNITTING MACHINE

BACKGROUND AND SUMMARY OF THE INVENTION

This invention pertains to improvements in sliver high pile fabric knitting machines, of the type generally illustrated and described in U.S. Pat. Nos. 1,114,414, 2,680,360 and 3,010,297. More particularly, the invention is directed to an improvement in a multi-feed sliver high pile fabric circular knitting machine, whereby the productive capacity of such machine may be substantially increased.

Sliver high pile fabric circular knitting machines have been known since at least Oct. 20, 1914, the date of grant of J. C. Tauber U.S. Pat. No. 1,114,414. During the decades since the grant of that patent, the machines have been steadily improved as the result of numerous innovations, many of which have become the subject of patents. Such machines now are capable of knitting a wide range of patterned and multi-colored fabrics, due to various improvements in needle selecting mechanisms and sliver feeding control devices. In order to increase the productive capacity of such machines, the number of individual sliver and yarn feeding stations has been progressively increased. At the present time, it is conventional for such multi-feed machines to incorporate 8, 12, or even 14 separate sliver and yarn feeding stations. However, significant increases in the productive capacity of such machines have been difficult to achieve. Due to the nature and complexity of such machines, increasing their productive capacity by increasing the number of sliver and yarn feeding stations, or by increasing the speed of rotation of the needle cylinder, has met with limited success only.

A recent attempt to increase the productive capacity of a sliver high pile fabric knitting machine is illustrated in U.S. Pat. No. 3,886,767, issued June 3, 1975. In the machine of that patent, additional yarn feeds are incorporated intermediate the sliver and yarn feeding stations, to increase the number of fabric courses knit during each revolution of the needle cylinder. While the device of that patent has enhanced the productive capacity of the knitting machine, the additional courses knit per revolution of the cylinder are plain fabric courses, lacking pile fibers.

The primary object of this invention is to provide a new and useful improvement to a sliver high pile fabric circular knitting machine, in which the production of the machine is increased by increasing the number of pile fiber-retaining fabric courses knit per revolution of the needle cylinder at a sliver and yarn feeding station.

A further object of the invention is to provide, for a multi-feed sliver high pile fabric circular knitting machine, means for knitting a plurality of pile fabric courses at each sliver and yarn feeding station, during each revolution of the needle cylinder, comprising providing at each station a sliver feeding device for delivering a plurality of individual rovings to the needles, a separate yarn feed associated with each roving and a separate set of stitch cams associated with each roving.

A further object is to provide an improved method for increasing the production of a sliver high pile fabric knitting machine comprising the steps of providing, at one or more sliver and yarn feeding stations, a sliver feeding device adapted to deliver a plurality of spaced rovings of sliver fibers to arcuately spaced locations of the needle circle, providing at least two angularly spaced yarn feeds to feed yarn to the needles, each of said yarn feeds being associated with a separate roving, providing at least two angularly spaced sets of knitting cams, each set of cams being associated with a separate roving, and rotating the needles relative to, and actuating the needles at, each station to knit a plurality of pile fiber-retaining courses at each such station.

Other objects and advantages of this invention will be apparent from the following description of a preferred embodiment thereof, reference being had to the accompanying drawing.

DETAILED DESCRIPTION OF THE INVENTION

Figure 1:
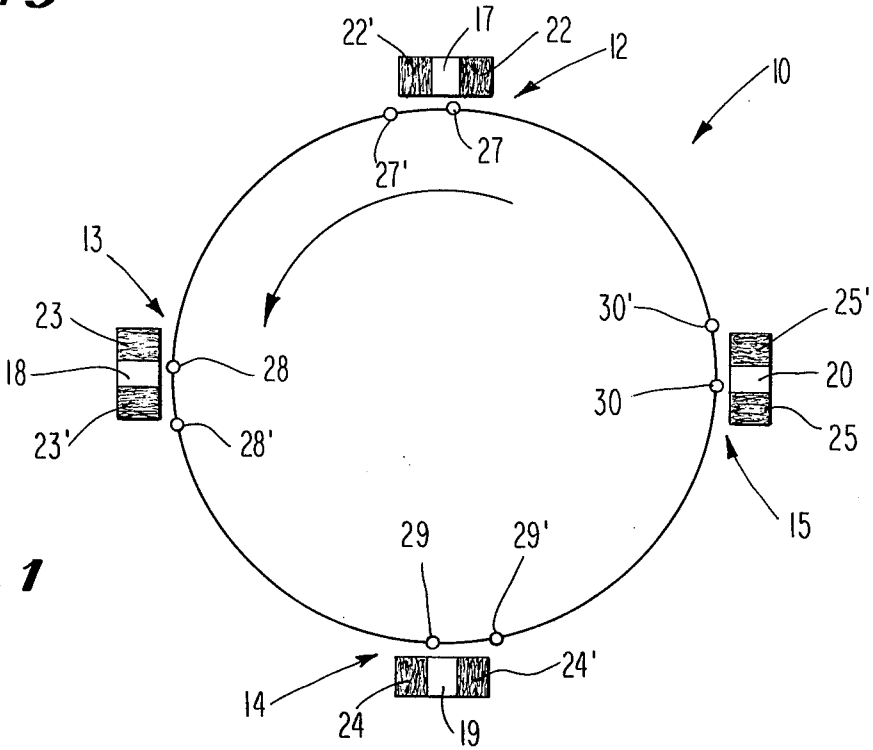
FIG. 1 is a schematic view in top plan showing the knitting head of a multi-feed sliver high pile fabric circular knitting machine incorporating this invention.

In FIG. 1, there is shown schematically in top plan, the knitting head of a multi-feed sliver high pile fabric circular knitting machine 10 to which this invention has been applied. The machine 10 is provided, for purpose of illustration, with four sliver and yarn feeding stations spaced uniformly about the circle of needles (not shown). The needles are of the conventional independent latch type, mounted for rotation in the usual rotatable needle cylinder (not shown). The needle cylinder and its complement of needles rotate in the direction indicated by the curved arrow in FIG. 1.

The four circumferentially spaced sliver and yarn feeding stations have been designated, proceeding in the direction of needle rotation, by the reference numerals 12, 13, 14, 15. Located at each of the feeding stations 12–15 are, respectively, sliver feeding means or devices 17, 18, 19, 20, frequently referred to as "cards". In the embodiment shown, each sliver feeding device is adapted to deliver two separate rovings of sliver fibers to the needles of the knitting machine 10. More particularly, sliver feeding device 17 delivers laterally spaced rovings 22, 22' to the needles, sliver feeding device 18 delivers laterally spaced rovings 23, 23' to the needles, sliver feeding device 19 delivers laterally spaced rovings 24, 24' to the needles and sliver feeding device 20 delivers laterally spaced rovings 25, 25' to the needles.

In the embodiment of the invention illustrated, two separate, angularly spaced yarn feeding means are disposed at each of the stations. Each such yarn feeding means comprises a conventional yarn tube disposed adjacent to the needle circle, for delivering yarn to the needles. At station 12, the spaced yarn feeding tubes are indicated by the reference numerals 27, 27'. At stations 13, 14, 15, the spaced pairs of yarn feeding tubes are designated, respectively, 28, 28', 29, 29', and 30, 30'. One each of the yarn feeding tubes is associated with one each of the rovings of sliver fibers fed to the needles of the machine. In each case, as illustrated in FIG. 1, each yarn feeding tube is disposed to feed yarn to the needles at a point adjacent to and trailing the fixed location where its roving is fed to the needles.

Figure 2:
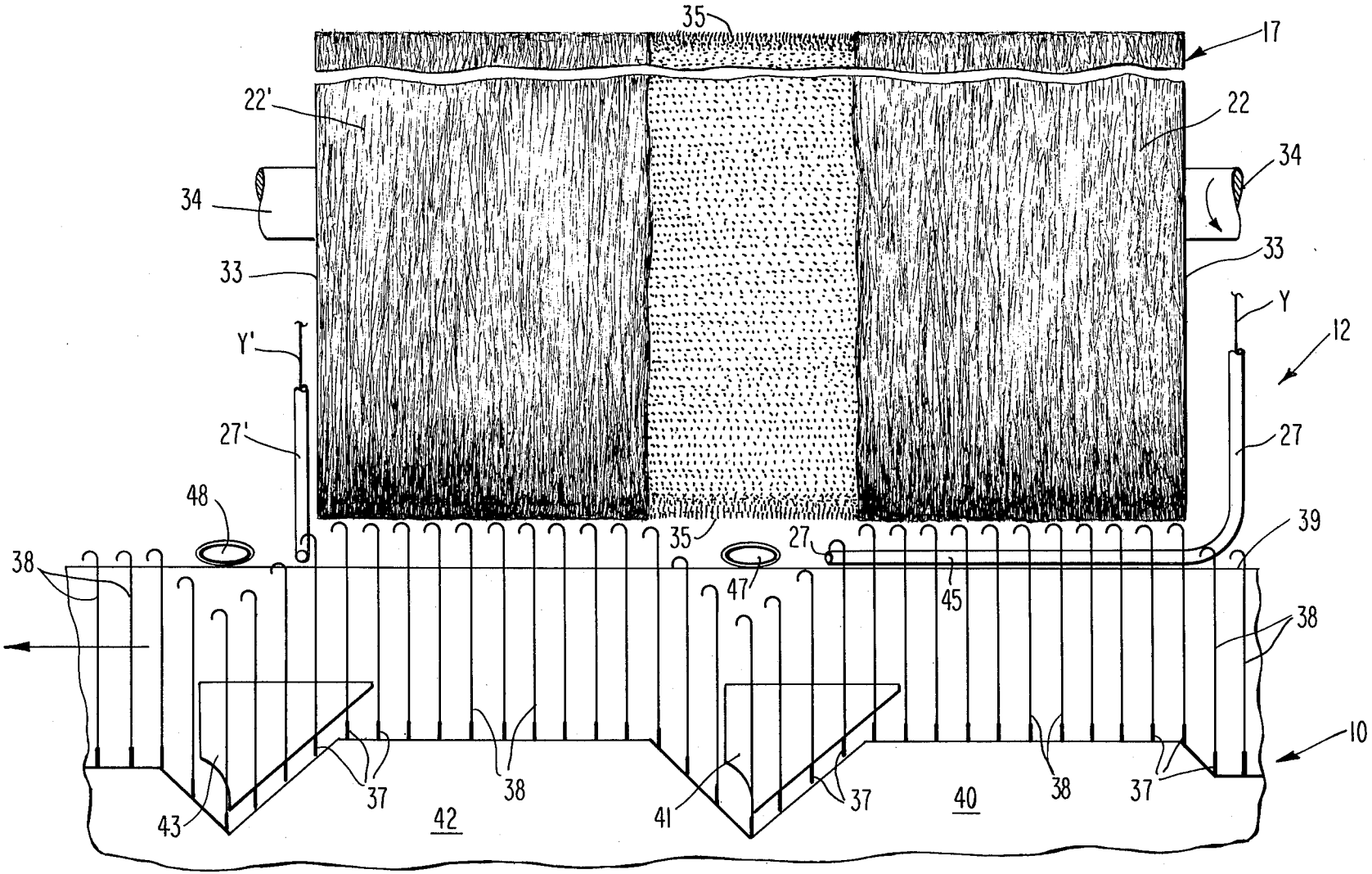
FIG. 2 is an enlarged fragmentary schematic view in elevation, looking outwardly from within the needle cylinder, illustrating the knitting cams, yarn feeds and a doffer at one of the sliver and yarn feeding stations of the machine.

Referring now to FIG. 2, there is illustrated schematically, in more detail, the improvement of this invention. FIG. 2 illustrates the details of sliver and yarn feeding station 12 looking outwardly from within the needle cylinder (not shown) of the knitting machine 10. The sliver feeding device 17 includes the usual rotatable doffer 33 mounted for rotation on shaft 34. The doffer 33 is provided with the usual wire covering 35. The sliver feeding device 17 also includes the usual wire-covered main cylinder (not shown) and any conventional type of sliver feeding rolls (also not shown) for delivering sliver from a source of supply to the main cylinder. Since, in the embodiment shown, the sliver feeding device 17 is feeding two separate, spaced rovings 22, 22' of sliver fibers to the needle circle, the sliver feed rolls may take the form of two sets of axially spaced feed rolls, each set comprising one or more mating pairs of rolls, of the type illustrated, for example, in U.S. Pat. Nos. 1,894,596, 2,964,932 and 3,413,823. It is important, in the practice of this invention, that the plural rovings 22, 22' be maintained in spaced or separated relationship at all times during their delivery to the needles by the sliver feeding device 17.

There is further illustrated in FIG. 2 an arc of the needle circle composed of a plurality of angularly spaced, independent latch needles 38 having butts 37. The needles are caused to rotate counter-clockwise, as indicated by the directional arrow. The knitting machine 10 further includes the usual sinker cap 39 and, in accordance with this invention, further includes at station 12 two sets of conventional knitting cams, 40, 42, each set of cams including, respectively, a stitch cam 41, 43.

The wire-covered periphery of doffer 33 is spaced above sinker cap 39, to provide for suitable clearance between the doffer and the top surface of the sinker cap. The yarn feeding tube 27 is disposed at a point in advance of doffer 33, and is provided with a horizontal tubular extension 45, disposed in the clearance between the doffer and the top surface of the dial cap 39. The horizontal extension 45 of yarn feed tube 27 terminates in an open end adjacent to and trailing the fixed location where doffer 33 delivers the fibers of roving 22 to the needles. At that point, yarn tube 27 delivers yarn Y to the needles 38. Similarly, yarn feeding tube 27' is provided with an open end terminating at a point adjacent to and trailing the fixed location where doffer 33 delivers the fibers of roving 22' to the needles 38. At such point, yarn tube 27' feeds yarn Y' to the needles.

In the practice of the embodiment of the invention illustrated, as the needles rotate relative to station 12, they first are raised by the knitting cams 40 to receive in their hooks, from doffer 33, sliver fibers from roving 22. Then, as the needles are caused to descend by the stitch cam 41, they receive yarn Y from yarn tube 27 in their hooks. The knitting cams thus are operative, in the usual manner, to actuate the needles 38 to knit the sliver fibers and yarn Y into a course of fiber-retaining pile fabric. As the needles continue to rotate, they again are raised, by the knitting cams 42, to receive from the doffer 33 sliver fibers from the roving 22'. As the needles are caused to descend by stitch cam 43, they receive yarn Y' from yarn tube 27' in their hooks. The needles thus again are actuated, by the second set of knitting cams, to knit the sliver fibers and yarn Y' into a second course of fiber-retaining pile fabric. Thus, by the arrangement shown, two complete pile fiber-retaining courses are knit at station 12, thereby doubling the rate of production of courses of pile fabric at that station.

The knitting cams 40, 42 may be of the curved type illustrated in U.S. Pat. No. 2,680,360, providing a curved or contoured cam track. The provision of such contoured or curved knitting cams ensures that the hooks of the needles 38 penetrate the wire covering 35 of the doffer 33 to a substantially uniform depth, during the period when the needles are elevated to receive or "rake" sliver fibers from the doffer.

If desired, conventional air nozzles 47, 48 may be utilized to project compressed air streams inwardly of the needle circle, to cause the sliver fibers to appear cleanly on the inside face of the tubular pile fabric (not shown) in the process of being knit. The air nozzles 47, 48 are disposed adjacent the open ends of the yarn tubes 27, 27' at positions trailing the yarn tubes in the direction of needle rotation. They are located generally vertically of the knitting points of the knitting cams with which they are associated. Each of the compressed air jets is provided with a flattened open end, resting on the top surface of the sinker cap. Flattening of their open ends in the manner illustrated permits the compressed air jets or nozzles 47, 48 to be accommodated within the narrow spacing between the periphery of the doffer and the upper surface of the sinker cap.

The knitting machine 10 is provided with the usual complement of sinkers (not shown) actuated in the usual manner by conventional sinker cams (also not shown), as will be readily understood by those skilled in the art. In embodiment shown in FIG. 2, a separate set of the sinker cams is associated with each set of knitting cams 40, 42. The sinkers are actuated by the two arcuately spaced sets of sinker cams to perform their usual loop forming function, and to act as web holders in the usual manner.

Figure 3:
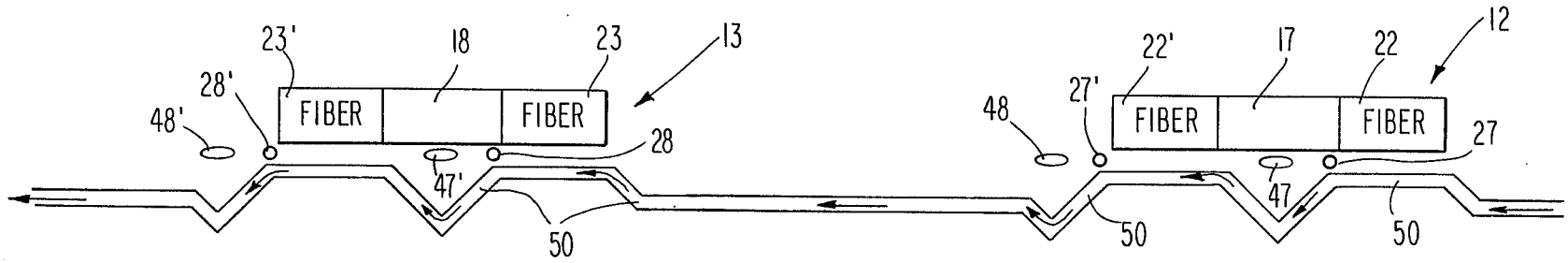
FIG. 3 is a fragmentary schematic view illustrating the travel of the needles of the knitting machine relative to the sliver and yarn feeding stations of the machine.

Preferably, each sliver and yarn feeding station of the knitting machine 10 is provided with a sliver feeding device adapted to deliver two separate, spaced rovings of sliver fibers to separate, angularly spaced fixed locations of the needle circle. Each such station also is provided with two sets of angularly spaced yarn feeds, sinker cams (not shown), knitting cams and compressed air jets, whereby two separate and complete courses of sliver knit pile fabric are formed at each station. Such an arrangement is shown schematically in FIG. 3, where stations 12 and 13 are illustrated, the latter station being provided with angularly spaced air nozzles 47' 48'. In FIG. 3, cam track 50 illustrates the path of travel of the butts 37 of the needles 38, as the needles rotate relative to the several sliver and yarn feeding stations of the machine 10.

Although, for the purpose of illustration, four sliver and yarn feeding stations have been illustrated in the drawing, it is understood that the knitting machine 10 may be provided with 8, 12, 14 or even more stations, as desired or required. In each such arrangement, each station, or less than all, as desired, may be provided with the improvement of this invention.

It also is within the scope and contemplation of this invention to modify the sliver and yarn feeding stations of the machine 10 to knit more than two complete courses of pile fabric at each station. For example, a sliver feeding device may be adapted to deliver three separate, spaced rovings to three separate, angularly spaced fixed locations of the needle circle at a station. In such event, the station is provided with three separate, angularly spaced yarn tubes and three separate sets of angularly spaced knitting cams and sinker cams. In such arrangement, the sliver feeding device may utilize three separate sets of sliver feed rolls, such as those illustrated in U.S. Pat. No. 2,694,907. Additionally, in such arrangement, three separate, angularly spaced compressed air nozzles preferably would be utilized, each located relative to its associated yarn and fiber feeds in the manner illustrated in FIGS. 1-3 hereof.

Although a preferred embodiment of this invention has been shown and described for the purpose of illustration, as required by Title 35 U.S.C. Sec. 112, it is to be understood that various changes and modifications may be made therein without departing from the spirit and utility of this invention, or the scope thereof, as set forth in the appended claims.

We claim:

1. In a sliver high pile fabric knitting machine having a rotatable circle of independent needles and a plurality of sliver and yarn feeding stations spaced circumferentially around the needle circle, the improvement comprising means for knitting a plurality of pile fiber-retaining fabric courses at one or more of said stations, said means including, at a single station, a. a sliver feeding device for delivering a plurality of separate laterally spaced individual rovings of sliver fibers to separate arcuately spaced fixed locations of the needle circle;

b. a separate yarn feeding tube associated with each roving and disposed adjacent each said spaced location of the needle circle for delivering yarn to the needles; and c. a separate set of knitting cams disposed adjacent each said spaced location of the needle circle for actuating the needles to receive sliver fibers and yarn and form said fibers and yarn into a course of pile fiber-retaining fabric.

2. The improvement of claim 1, further including compressed air delivery means associated with each roving.

3. In a sliver high pile fabric knitting machine having a rotatable circle of independent needles and a plurality of sliver and yarn feeding stations spaced circumferentially around the needle circle, the improvement comprising means for knitting a plurality of pile fiber-retaining fabric courses at each of one or more of said stations, said means including, at a single station, a. a sliver feeding device adapted to deliver each of a plurality of separate laterally spaced rovings to one of separate angularly spaced fixed locations of the needle circle;

b. yarn feeding means comprising a plurality of angularly spaced yarn tubes, each said yarn tube being disposed at a position adjacent to and trailing one of said fixed locations in the direction of needle rotation;

c. a plurality of angularly spaced stitch cams, each stitch cam being disposed at a position adjacent to and trailing one of said fixed locations in the direction of needle rotation; and d. a plurality of angularly spaced compressed air jets, at least one each of said air jets being disposed at a position adjacent to and trailing one of said fixed locations in the direction of needle rotation.

4. The improvement of claim 3, further including an annular sinker cap disposed externally of the needle circle, wherein a. the sliver feeding device includes a rotatable doffer disposed adjacent the needle circle and spaced above the sinker cap; and b. at least one yarn tube and one compressed air jet are disposed in the space between said doffer and said sinker cap.

5. The improvement of claim 4, wherein a. at least one yarn tube is disposed at a point in advance of said sliver feeding device relative to the direction of needle rotation, and is provided with a tubular extension disposed in the space between the sinker cap and the doffer for delivering yarn to the needles; and b. each of the compressed air jets includes conduits terminating in open and flattened ends disposed adjacent the needle circle.

6. The method of modifying a sliver high pile fabric knitting machine having a circle of independent needles and at least one sliver and yarn feeding station disposed adjacent the needle circle, to increase the pile fabric production thereof, comprising the steps of a. providing at each station a sliver feeding device adapted to deliver a plurality of separate laterally spaced individual rovings of sliver fibers to separate arcuately spaced locations on the needle circle;

b. providing a plurality of arcuately spaced yarn feeding means at each station to feed yarn to the needles, each of said yarn feeding means being associated with a separate roving;

c. providing a plurality of arcuately spaced sets of knitting cams at each station, each said set of knitting cams being associated with a separate roving and its associated yarn feeding means, and each said set of knitting cams being operative to actuate needles to receive sliver fibers and yarn and form said fibers and yarn into a course of sliver knit fabric at said station; and d. rotating the circle of needles relative to each sliver and yarn feeding station and actuating the needles at each said station to knit a plurality of fiber-retaining pile fabric courses at each said station.

7. The method of claim 6, wherein the knitting machine has a plurality of sliver and yarn feeding stations, and wherein the steps of said method are applied to at least two of said stations.

8. The method of claim 7, wherein the steps of said method are applied to all of said stations.

9. The method of claim 8, further including the step of providing a plurality of arcuately spaced compressed air jets at each station, at least one of each said air jets being associated with one of the rovings of sliver fibers at each station.

* * * * *